US006199643B1

(12) United States Patent
Hesse et al.

(10) Patent No.: US 6,199,643 B1
(45) Date of Patent: Mar. 13, 2001

(54) METHOD AND APPARATUS FOR DIRECTIONAL BORING

(75) Inventors: Alfons Hesse; Franz-Josef Püttmann, both of Lennestadt (DE)

(73) Assignee: Tracto-Technik Paul Schmidt Spezialmaschinen, Lennestadt (DE)

( * ) Notice: Subject to any disclaimer, the term of this patent is extended or adjusted under 35 U.S.C. 154(b) by 0 days.

(21) Appl. No.: 09/123,036

(22) Filed: Jul. 27, 1998

(30) Foreign Application Priority Data

Jul. 29, 1997 (DE) ..... 197 32 532

(51) Int. Cl.[7] ..... E21B 6/08; E21B 7/08
(52) U.S. Cl. ..... 175/61; 175/19; 175/56
(58) Field of Search ..... 175/55, 19, 56, 175/61

(56) References Cited

U.S. PATENT DOCUMENTS

| | | | | |
|---|---|---|---|---|
| 3,235,014 | * | 2/1966 | Brooks | 173/197 |
| 3,557,875 | * | 1/1971 | Solum | 166/286 |
| 3,579,912 | * | 5/1971 | Panko et al. | 451/340 |
| 3,645,343 | * | 2/1972 | Mays | 175/171 X |
| 3,734,209 | * | 5/1973 | Haisch et al. | 175/57 |
| 3,734,212 | * | 5/1973 | Perlewitz | 175/171 |
| 4,384,625 | * | 5/1983 | Roper et al. | 175/66 |
| 4,694,913 | * | 9/1987 | McDonald et al. | 175/61 |
| 4,705,116 | * | 11/1987 | Carruthers | 175/19 |
| 4,848,486 | | 7/1989 | Bodine . | |
| 5,257,667 | * | 11/1993 | Sano et al. | 173/49 |
| 5,540,295 | | 7/1996 | Serrette . | |

FOREIGN PATENT DOCUMENTS

| | | |
|---|---|---|
| 0 195 559 | 9/1986 | (EP) . |
| 0 247 767 | 12/1987 | (EP) . |
| 0 352 979 | 1/1990 | (EP) . |

* cited by examiner

*Primary Examiner*—George Suchfield

(57) ABSTRACT

In directional boring using a boring apparatus having a driven string and a drill head with an excavating tool moving in an orbit about the longitudinal axis of the string, the tool moves with substantially constant angular velocity when boring straight ahead, but when boring along a curve it is stopped and set in vibration in order to obtain more accurate control of the curve.

10 Claims, 4 Drawing Sheets

METHOD AND APPARATUS FOR DIRECTIONAL BORING

FIELD OF THE INVENTION

The invention relates to a method for directional boring using a boring apparatus which permits boring to be performed either straight ahead or along a curved path, as desired, and to apparatus for putting the method into practice.

BACKGROUND AND PRIOR ART

Boring apparatus of this kind comprise a driven drill string having a drill head the form of which may vary widely. The drill string is usually mounted on a carriage which runs on rails and is connected to a linear drive and has a rotary and/or forward feed (thrust) drive by which the string can be set in rotation and pressed forward into the ground.

To enable directional boring to be performed, such apparatus has a drill head having an eccentricity: that is to say, the drill head is such that lateral steering forces occur which bring about travel along a curve but which can be overcome when boring straight ahead. To do this, during the straight-ahead boring the drill head having the eccentricity rotates about the axis of the string with constant angular velocity so that the effect of the eccentricity is lost. On going over to curve boring the part exhibiting the eccentricity, or the drill head, is kept stationary in a particular angular position for a certain length of time, and remains in this angular position until completion of the curved path or so long as the predetermined curved path is maintained. If the drill head departs from the predetermined curve of the path, a correction of the angular position is necessary until the predetermined path curve is regained.

The nature of the drill string, of the eccentricity and of the drill head varies widely from case to case. Thus published European patent application 0 247 767 discloses a drill head connected to a rotary/thrust string and having an oblique face which permits straight-ahead boring so long as the drill head rotates uniformly and—in the absence of rotation—curved boring by lateral displacement of the soil in front of the drill head.

The known methods and apparatus for directional boring are all based on the principle that the drill string rotates during the straight-ahead boring and accordingly the drill head describes an envelope which is larger—usually substantially larger—than the diameter of the string or of the drill head, while during the travel along a curve the drill does not rotate and the is driven forward only by thrust and/or impact.

When boring along a curve, however, the advance into the ground is problematical, since the drill head is then not performing any excavating work, but only displacement work. In the case of soft soils this is not a problem, but in the case of harder or even stony soils the work of displacement required is quite considerable. Hence as a result of the tool being stationary in general either high thrust forces or special excavation methods are necessary. High thrust forces require a string which is equal to the task, in particular one with adequate resistance to buckling, with a correspondingly high weight, and can only be manufactured with corresponding high machine effort. This also applies to the case when the thrust when boring along a curve is effected by means of a percussion device. In addition, high thrust forces require a correspondingly firm anchorage, which it is particularly difficult to provide in the case of boring apparatus placed above ground and attached obliquely.

On the other hand, however, the string must also not be too rigid, since boring along a curve is only possible if the string is sufficiently elastic to bend to the corresponding curvature.

A boring apparatus is also known from European specification 0 195 559 of which the angled drill head, fitted at the end of a rotatable string, is provided with a concentric nozzle from which a high pressure jet issues to loosen and excavate the soil located in front of the drill head. While this apparatus avoids the need for high driving or thrust power when boring along a curve, for this purpose it nevertheless requires very high pump power to produce the fluid stream which excavates the soil. In addition, the soil excavation by means of the fluid jet cannot be precisely controlled, so that an accidental washout can lead to the formation of a cavity larger than that required for the forward travel. Such cavities can very easily lead to an undesired directional deviation. Independently of this, the directional stability when boring along a curve also suffers from the soil surrounding the drill head becoming greatly softened by the excavation or flushing fluid.

Finally, the high fluid pressures required result in the introduction of correspondingly large quantities of fluid into the ground, which is undesirable on both environmental and economic grounds. For the pressure fluid is generally a bentonite/water suspension, part of which remains in the ground while the major part flows back along the drill string towards the launch pit, where the suspension has to be collected and disposed of.

A further point is that the bentonite in the suspension brings about considerable frictional wear both in the supply line to the drill head and in the nozzle and as it flows back along the drill string.

OBJECT OF THE INVENTION

The object of the invention, therefore, is to provide a method and apparatus for boring which, with relatively small mechanical outlay, permits of low-wear boring along curves with high directional stability

SUMMARY OF THE INVENTION

This object is achieved by a method which makes use of a boring machine with a driven string and an excavation tool rotating round the longitudinal axis of the string, which in the case of straight ahead boring rotates at a substantially constant angular velocity. For boring along a curve, however, the rotation of the tool is interrupted and the tool is set in vibration in order to facilitate its penetration into the ground and to reduce the thrust work which has to be performed to displace the soil. A further important advantage is that as a result of the vibration only a relatively low static friction occurs both on the string and on the drill head.

The tool can consist of a cutting and excavating edge on an oblique-face drill head such as is described in European published application 0 247 767. When the drill head is not rotating, the oblique face serves as a steering face and causes the drill head to be deflected in the direction opposite the oblique face. Moreover the drill head acts like a wedge and forces the soil in front of the drill head to one side during travel along a curve. In the method of the invention this does not require any expensive thrust drive, since a substantial part of the work of displacement is applied by a vibrator. Such a vibrator can be located in the drill head, out of the ground, for example in the starting pit to one side of the drill string, or even in the driving unit for rotation and advance of the string.

It is particularly advantageous to use a vibrator which is releasably flange-mounted on to the side of the drill string. By this means it is possible to operate any conventional boring apparatus having a drill string using the method of the invention: all that is require is for the vibrator to be moved whenever the currently last section of the string has moved far enough into the ground and a new section is attached.

A vibrator releasably attached to the string may comprise two half shells hinged together to as to embrace the pipe in situ and provided with releasable locking means. Suitable locking means is, for example, a threaded clamping bolt mounted pivotably on one of the half-shells, and a lock-nut, which in the locked state bears on two lugs or on either side of a slot in the other half-shell.

The vibrator can be fitted on a sliding carriage, which enables the vibrator to be brought up to the drill string from the side and to move with the drill string in the direction of advance.

The vibrator can also be connected to a chuck to grasp the drill string by means of two clamping jaws.

The vibrator can be designed so that at least part of the oscillatory movement is introduced into the drill string in the longitudinal direction.

BRIEF DESCRIPTION OF THE DRAWINGS

The invention will now be described in more detail, by way of example, with reference to an embodiment shown in the drawings, in which.

DETAILED DESCRIPTION OF A PREFERRED EMBODIMENT OF THE INVENTION

Figure 1:
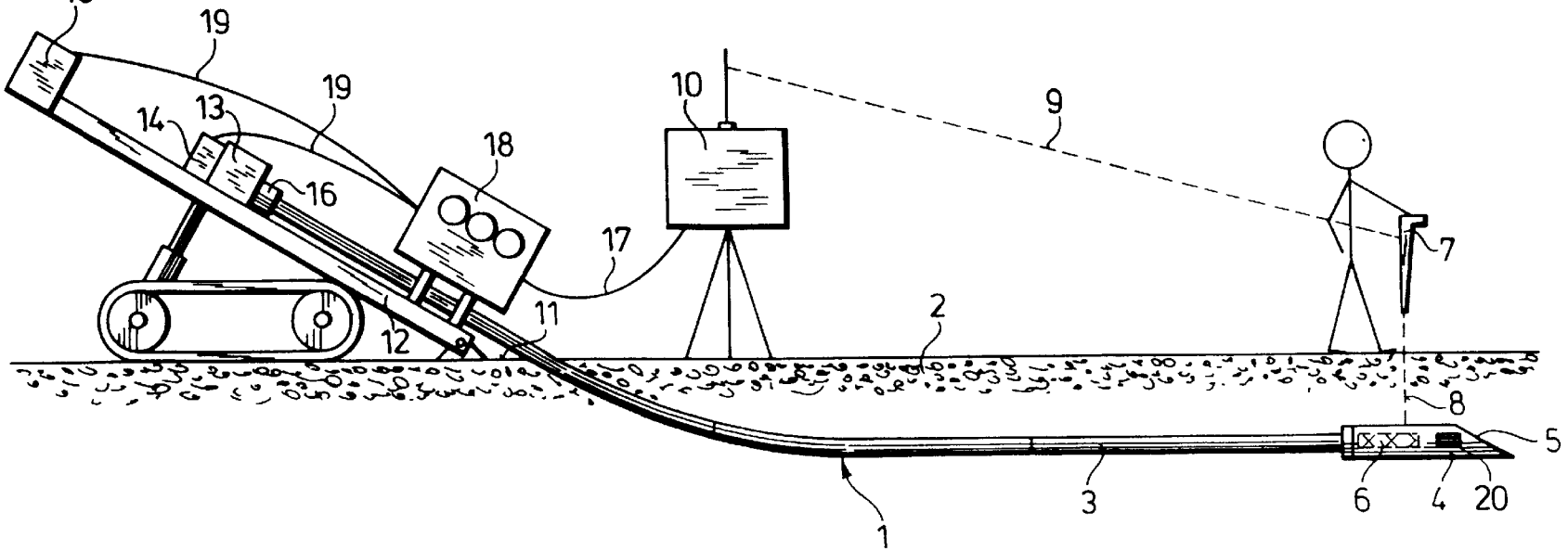
FIG. 1 shows a boring apparatus suitable for carrying out the method of the invention, in action.

In the method of the invention a bore 1 in the ground 2 is produced by means of an elastic drill string 3 made up of individual pipes. At the end of the drill string 3 there is a drill head 4 with a steering face or bevel 5, which is connected non-rotatably to the drill string 3. The front transverse edge of the bevel acts as an excavating tool and on rotation of the string describes an envelope about the longitudinal axis of the string. In the drill head 4 a transmitter 6 is fitted which transmits data by radio to a receiver 7 which relate to the depth of the drill head 4 below the surface of the ground, the position of the drill head 4 in the ground, its inclination, the angular position of the steering face 5 relative to the longitudinal axis of the drill head 4 and optionally the temperature at the drill head 4. A radio connection between the transmitter 6 and a receiver 7 is indicated by the broken line 8.

A further radio connection 9 communicates the above-mentioned data from the receiver 7 to a display device 10 in the vicinity of a carriage 12 located at the start. This carriage 12 includes a rotary drive 13 for the drill string 3, a vibrator 14 acting on the drill string 3 and a thrust drive 15. The drill string 3 is coupled to the rotary and thrust drive by a drill string connector 16.

From the display device 10 a cable connection 17 leads to a switch box 18 with an operator's console, by means of which it is possible via respective cable connections 19 to control the rotary drive 13, the vibrator 14 and the thrust drive 15.

In place of the vibrator 14 it is also possible to use a vibrator 20 integrated in the drill head 4, which is then controlled via a lead (not shown) running through the drill string 3.

The apparatus shown in FIG. 1 can be operated in two different ways. If the drill string 3 is driven rotating and thrusting through the ground 2, a straight bore results. In this case the deflection of the eccentrically acting drill head 4 which is made possible by the steering face 5 on the drill head is neutralized by the uniform rotation of the drill string 3.

Boring along a curve using the apparatus shown in FIG. 1 is initiated by interrupting the rotation of the drill head 4, for example in the control position or angular position of the oblique face 5 shown, while the thrust drive 15 continues to operate and the vibrator 16 or the vibrator 20 in the drill head 4 is switched on.

Figure 2:
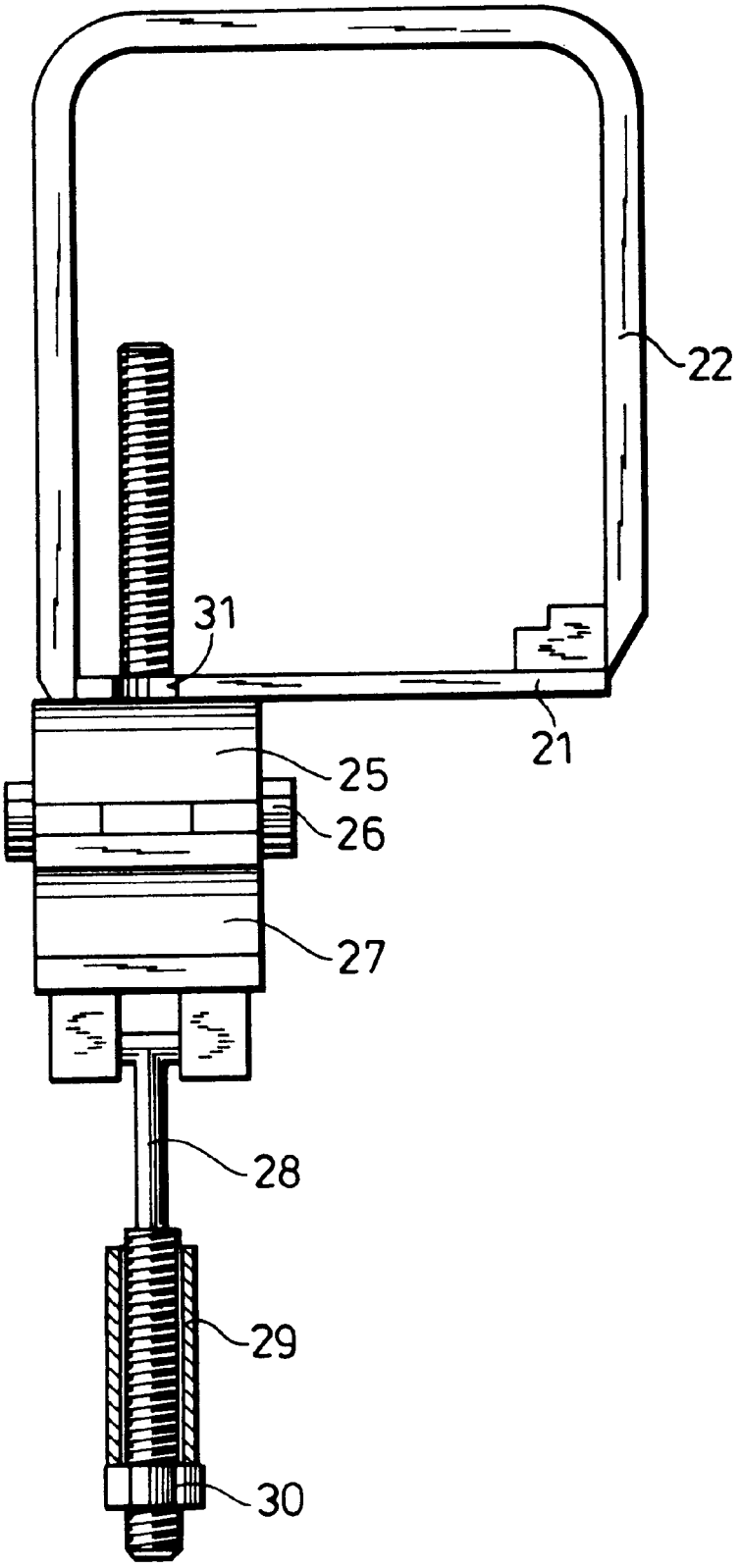
FIG. 2 shows a vibrator console for flang-mounting laterally on to a drill string.
Figure 3:
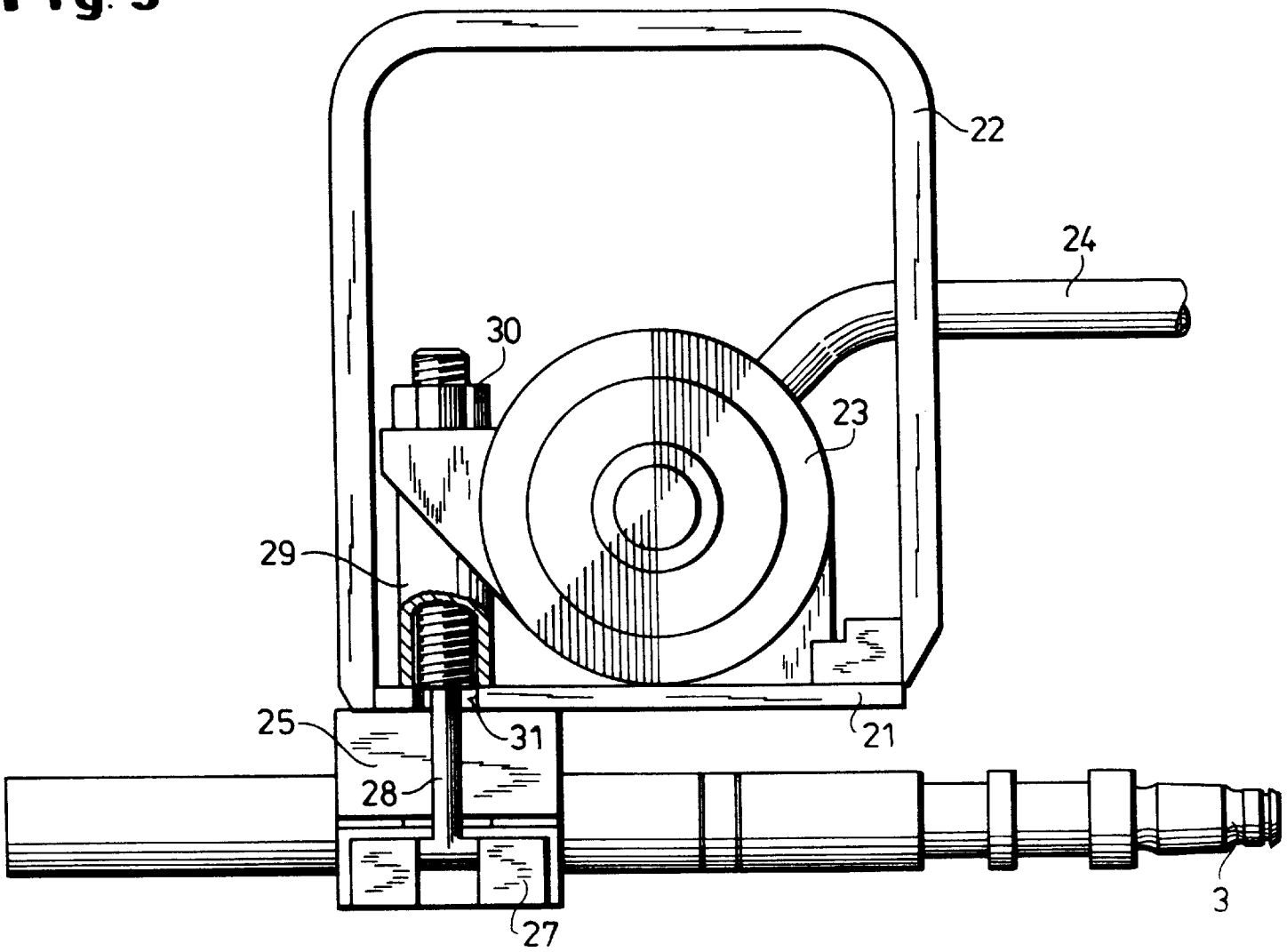
FIG. 3 shows the console of FIG. 2 with a vibrator laterally on a drill string.

A third variant for the arrangement of the vibrator is shown in FIG. 2 and FIG. 3. It comprises a console 21 with carrying strap 22 and a vibrator 23 fitted on the console with a supply line 24 for supplying energy to the vibrator. The console 21 is fixed to a half-shell 25, to which a counter-shell 27 is pivotably attached by a hinge 26. On the counter-shell 27 a clamping bolt 28 with a spacer bushing 29 and a lock-nut 30 is pivotably mounted.

When they are closed, the two shells 25, 27 embrace the string 3 and, when the lock-nut 30 is tightened, the foot of the spacer sleeve 29 is supported on either side of a slot 31 on the console 21, so that the vibrator 23 is firmly connected to the string 3 by means of the two half-shells 25, 27.

The vibrator is moved along with the string 3 in the direction of thrust until a new string section is attached to the string 3 located in the ground and has to be connected to the drill string connector 16. The lock-nut 30 is then loosened and the two half-shells 25, 27 are folded apart in order to transfer the vibrator 23 to the new string section.

Figure 4:
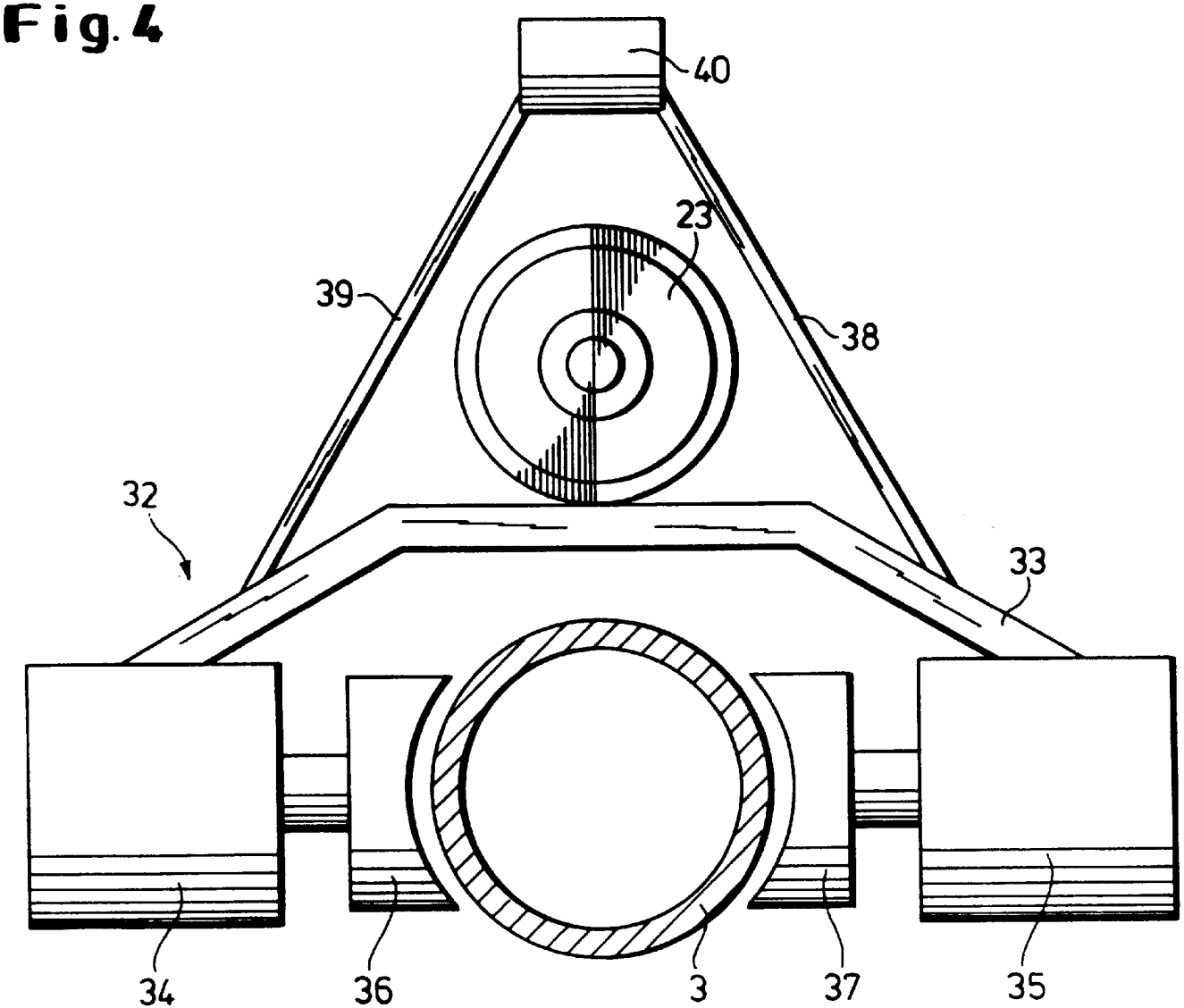
FIG. 4 shows a vibrator with a chuck for fixing to the drill string.

The vibrator 23 shown in FIG. 4 is connected to a chuck 32 fitted with a stirrup 33. For this purpose the vibrator is mounted on the stirrup 33, to each end of which a hydraulic drive 34, 35 for a respective clamping jaw 36, 37 is fitted. The stirrup 33 is connected to a suspension 40 by struts 38, 39.

What is claimed is:

1. Method for directional boring, the method comprising boring into the earth with a boring apparatus, the boring apparatus comprising:

a drill string;

a rotary drive driveably engaged with the drill string;

a thrust drive driveably engaged with the drill string;

at least one excavating tool connected to the drill string, arranged eccentrically to the drilling axis, and a vibrator engaged with the drill string; whereby for straight-ahead boring the rotary drive is activated whereby the at least one excavating tool moves on a circular orbit, and for boring along a curve the rotary drive is deactivated whereby the at least one excavating tool is stationary, and the vibrator is activated.

2. Method as claimed in claim 1, wherein for straight-ahead boring the vibrator is also activated.

3. Apparatus for directional boring, comprising:

a drill string;

a rotary drive driveably engaged with the drill string;

a thrust drive driveably engaged with the drill string;

at least one excavating tool connected to the drill string, arranged eccentrically to the drilling axis such that when the rotary drive is activated the at least one excavating tool moves in a circular orbit whereby the apparatus bores straight-ahead, and when the rotary drive is deactivated the at least one excavating tool is stationary whereby the apparatus bores along a curve, and a vibrator engaged with the drill string.

4. Apparatus as claimed in claim 3, wherein the vibrator is connected to the rotary drive .

5. Apparatus as claimed in claim 3, further comprising a drill head, wherein the drill string has a front end, the drill head being located at the front end of the drill string, and wherein the vibrator is fitted in the drill head.

6. Apparatus as claimed in claim 3, wherein the vibrator is fitted on the drill string.

7. Apparatus as claimed in claim 6, wherein the vibrator is mounted on a console and is clamped on the drill string by means of two half-shells embracing the string.

8. Apparatus as claimed in claim 3, wherein the vibrator is connected to a chuck.

9. Apparatus as claimed in claim 8, wherein the chuck includes two opposed clamping jaws, wherein at least one of the opposed clamping jaws is movably mounted and driven.

10. Apparatus as claimed in claim 3, wherein at least part of the vibration is introduced into the string in a longitudinal direction.

* * * * *